US010381175B2

(12) United States Patent
Yang et al.

(10) Patent No.: US 10,381,175 B2
(45) Date of Patent: Aug. 13, 2019

(54) KEY STRUCTURE

(71) Applicant: Darfon Electronics Corp., Taoyuan (TW)

(72) Inventors: Sung-Fu Yang, Taoyuan (TW); Chen-An Chang, Taoyuan (TW)

(73) Assignee: DARFON ELECTRONICS CORP., Toayuan (TW)

( * ) Notice: Subject to any disclaimer, the term of this patent is extended or adjusted under 35 U.S.C. 154(b) by 0 days.

(21) Appl. No.: 16/049,948

(22) Filed: Jul. 31, 2018

(65) Prior Publication Data

US 2019/0122837 A1 Apr. 25, 2019

(30) Foreign Application Priority Data

Oct. 20, 2017 (TW) ..... 106136262 A

(51) Int. Cl.
*H01H 13/14* (2006.01)
*H01H 3/60* (2006.01)
(Continued)

(52) U.S. Cl.
CPC ..... *H01H 13/14* (2013.01); *H01H 1/54* (2013.01); *H01H 3/60* (2013.01); *H01H 3/125* (2013.01);
(Continued)

(58) Field of Classification Search
CPC ..... H01H 13/14; H01H 1/54; H01H 5/02; H01H 2221/04; H01H 2221/026; H01H 3/125; H01H 3/60
See application file for complete search history.

(56) References Cited

U.S. PATENT DOCUMENTS 3,906,417 A * 9/1975 Serras-Paulet ..... H01H 13/52 335/205
5,799,772 A 9/1998 Sanda et al.
(Continued)

FOREIGN PATENT DOCUMENTS

CN 202940152 U 5/2013
CN 104051175 A 9/2014
(Continued)

OTHER PUBLICATIONS

CN Office Action dated Nov. 28, 2018 in Chinese application (No. 201711023008.X).

*Primary Examiner* — Felix O Figueroa
(74) *Attorney, Agent, or Firm* — McClure, Qualey & Rodack, LLP

(57) ABSTRACT

A key structure including a baseplate, a key cap, a first lever, a second lever, a first magnetic member, a second magnetic member and a first buffer material is provided. The first magnetic member is disposed on the baseplate and located between the first lever and the second lever. The second magnetic member is disposed on the first lever and corresponding to the first magnetic member. The first magnetic member has a first portion. The second lever has a second central end. The first portion is adjacent to the second central end. When the key cap moves to a higher position, the first and second magnetic members move towards each other. The second magnetic member has a second portion and a third portion. The first buffer material is provided between the first and second portions and between the second central end and the third portion, respectively.

16 Claims, 6 Drawing Sheets

(51) Int. Cl.
*H01H 1/54* (2006.01)
*H01H 3/12* (2006.01)

(52) U.S. Cl.
CPC ... *H01H 2221/026* (2013.01); *H01H 2221/04* (2013.01)

(56) References Cited

U.S. PATENT DOCUMENTS

| | | | | |
|---|---|---|---|---|
| 6,022,157 | A | 2/2000 | Shih-Hung | |
| 6,677,843 | B1 * | 1/2004 | Monroe | H01H 13/705 200/512 |
| 8,629,362 | B1 * | 1/2014 | Knighton | H01H 13/52 200/344 |
| 8,766,122 | B2 | 7/2014 | Takiguchi et al. | |
| 8,970,331 | B2 * | 3/2015 | Chang | H01H 13/702 200/341 |
| 9,064,651 | B2 * | 6/2015 | Hsu | H01H 13/02 |
| 9,236,205 | B2 * | 1/2016 | Hsu | H01H 13/52 |
| 9,343,247 | B2 * | 5/2016 | Hsu | H01H 13/20 |
| 9,412,535 | B2 * | 8/2016 | Hsu | H01H 13/14 |
| 9,953,776 | B2 * | 4/2018 | Liao | H01H 13/14 |
| 9,966,202 | B2 * | 5/2018 | Liao | G06F 3/0202 |
| 9,984,840 | B2 * | 5/2018 | Hsu | H01H 13/85 |
| 2015/0047959 | A1 * | 2/2015 | Wu | H01H 3/125 200/344 |
| 2015/0332875 | A1 | 11/2015 | Hsu | |
| 2019/0088428 | A1 * | 3/2019 | Chen | H01H 13/83 |

FOREIGN PATENT DOCUMENTS

| | | | |
|---|---|---|---|
| CN | 104425162 | A | 3/2015 |
| CN | 106128810 | A | 11/2016 |
| CN | 107492462 | A | 12/2017 |

* cited by examiner

KEY STRUCTURE

This application claims the benefit of Taiwan application Serial No. 106136262, filed Oct. 20, 2017, the subject matter of which is incorporated herein by reference.

BACKGROUND OF THE INVENTION

Field of the Invention

The invention relates in general to a key structure, and more particularly to a key structure having noise reduction function.

Description of the Related Art

Keyboard is a commonly used manual input device. For the user to use the keyboard more flexibly, each magnetic key is normally equipped with a supporting member and/or a balance rod to increase the structural strength of a key cap. Moreover, the key cap can move upwards and downwards with respect to the baseplate through the supporting member and/or the balance rod. However, when the key cap moves upwards and downwards, the supporting member or the balance rod normally collide with the baseplate and generate noises. Besides, frictions may occur at the junction between the supporting member or the balance rod and the baseplate and generate noises. Furthermore, the magnetic member and the supporting member have structural interference and may easily collide and generate noises. The above problems need to be resolved.

SUMMARY OF THE INVENTION

The invention is directed to a key structure having a buffer material disposed at the interference or the friction between two elements to avoid collision and friction. Thus, the noises generated when the elements actuate with respect to each other are reduced.

According to one embodiment of the present invention, a key structure including a baseplate, a key cap, a first lever, a second lever, a first magnetic member, a second magnetic member and a first buffer material is provided. The key cap is disposed on the baseplate. The first lever is pivotably disposed between the baseplate and the key cap. The second lever is pivotably disposed between the baseplate and the key cap, wherein the key cap moves upwards and downwards with respect to the baseplate through the first lever and the second lever. The first magnetic member is disposed on the baseplate and located between the first lever and the second lever. The second magnetic member is disposed on the first lever and corresponding to the first magnetic member. A magnetic force generated between the first magnetic member and the second magnetic member enables the key cap to move to a higher position from a lower position. The first magnetic member has a first portion. The second lever has a second central end. The first portion is adjacent to the second central end. When the key cap moves to the higher position, the first magnetic member and the second magnetic member move towards each other. The second magnetic member has a second portion leaning against the first portion and a third portion leaning against the second central end. The first buffer material is provided between the first portion and the second portion and between the second central end and the third portion, respectively.

According to another embodiment of the present invention, a key structure including a baseplate, a key cap, a first lever, a second lever, a first magnetic member, a second magnetic member and a first buffer material is provided. The baseplate has a first connecting portion and a second connecting portion. The key cap is disposed on the baseplate. The first lever has a first central end, a first outer edge and a third connecting portion. The third connecting portion is located between the first central end and the first outer edge. The third connecting portion is rotatably coupled to the first connecting portion. The first outer edge is rotatably coupled to the key cap. The second lever has a second central end, a second outer edge and a fourth connecting portion. The fourth connecting portion is located between the second central end and the second outer edge. The fourth connecting portion is rotatably coupled to the second connecting portion. The second outer edge is rotatably coupled to the key cap. The key cap moves upwards and downwards with respect to the baseplate between a lower position and a higher position through the first lever and the second lever. The first magnetic member is disposed on the baseplate and has a first portion. The second magnetic member is disposed at the first central end of the first lever. A magnetic attraction force is generated between the first magnetic member and the second magnetic member. The second magnetic member has a second portion and a third portion. The second portion extends above the first magnetic member. The third portion extends above the second central end of the second lever. The first buffer material is provided between the second portion and the first magnetic member and between the third portion and the second lever, respectively. When the key structure receives an external force which enables the key cap to move towards the lower position, the first magnetic member and the second magnetic member move away from each other, and the second magnetic member and the second central end of the second lever both move upwards. Thus, the first buffer material can reduce the collision sound generated between the second magnetic member and the second central end. When the external force disappears, the magnetic attraction force enables the key cap to move towards the higher position, the first magnetic member and the second magnetic member move towards each other, and the second portion of the second magnetic member moves downwards. Thus, the first buffer material can reduce the collision sound generated between the second portion and the first portion of the first magnetic member.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements.

Figure 1A:
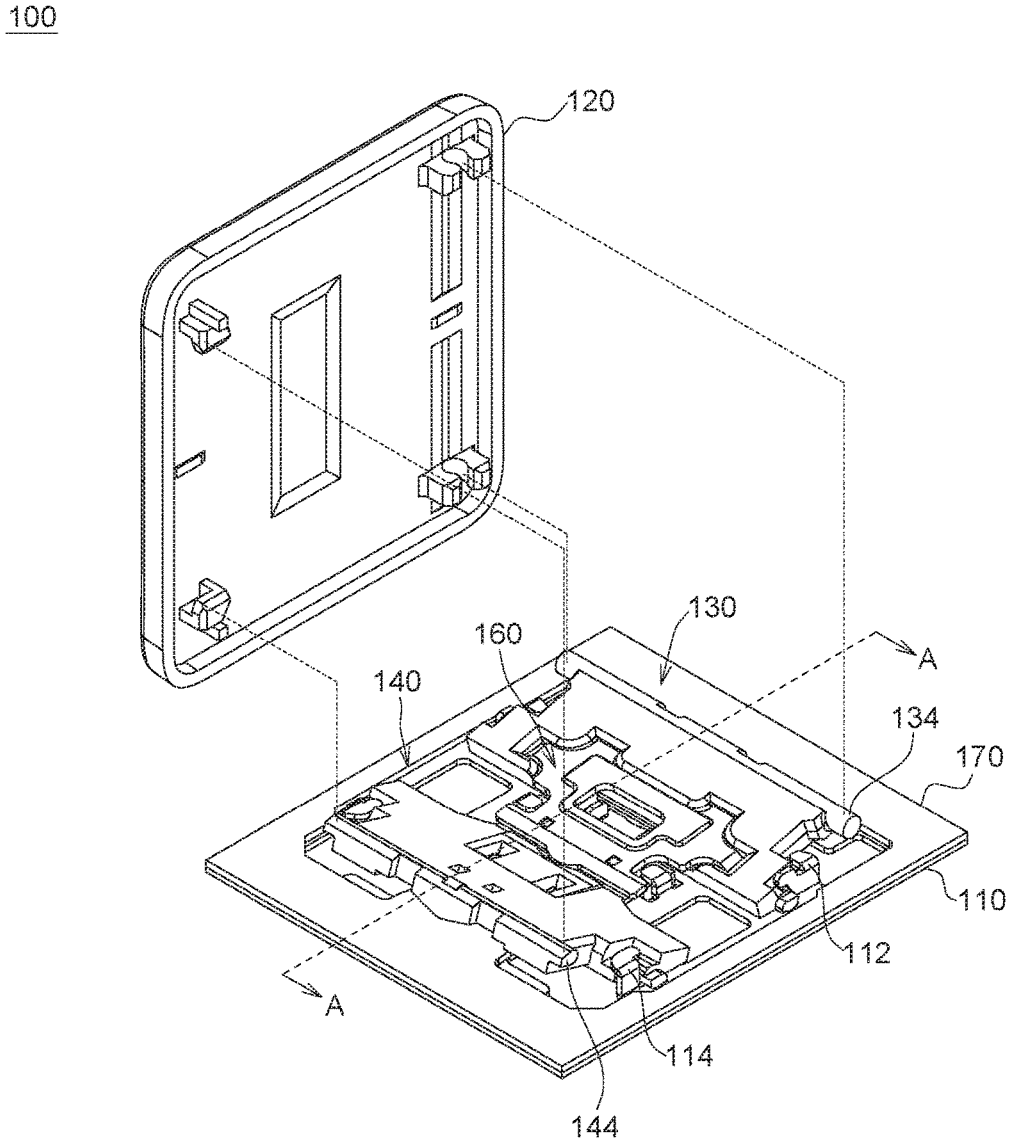
FIG. 1A is an assembly diagram of a key structure according to an embodiment of the present invention.
Figure 1B:
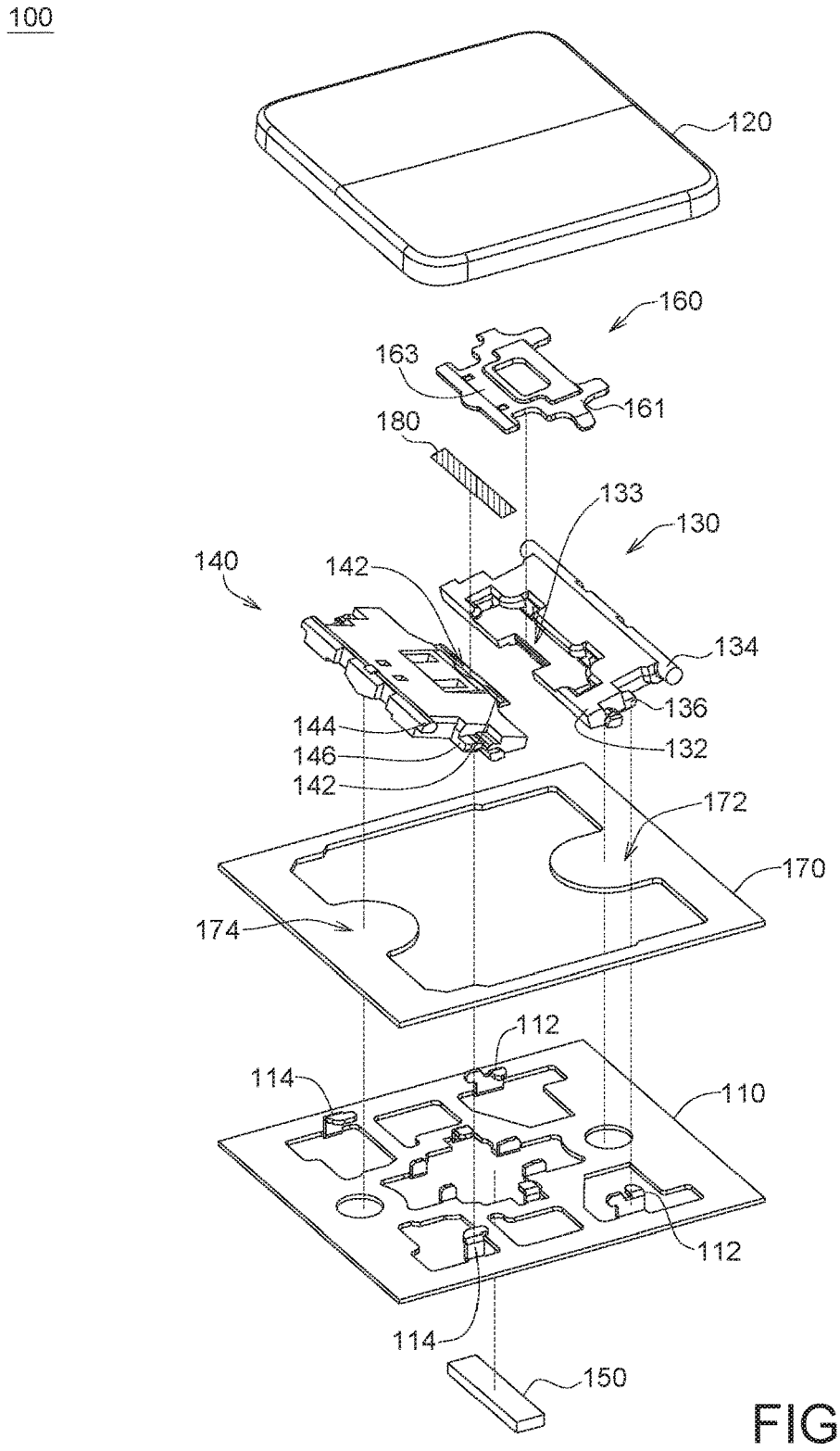
FIG. 1B is an explosion diagram of a key structure according to an embodiment of the present invention.
Figure 2A:
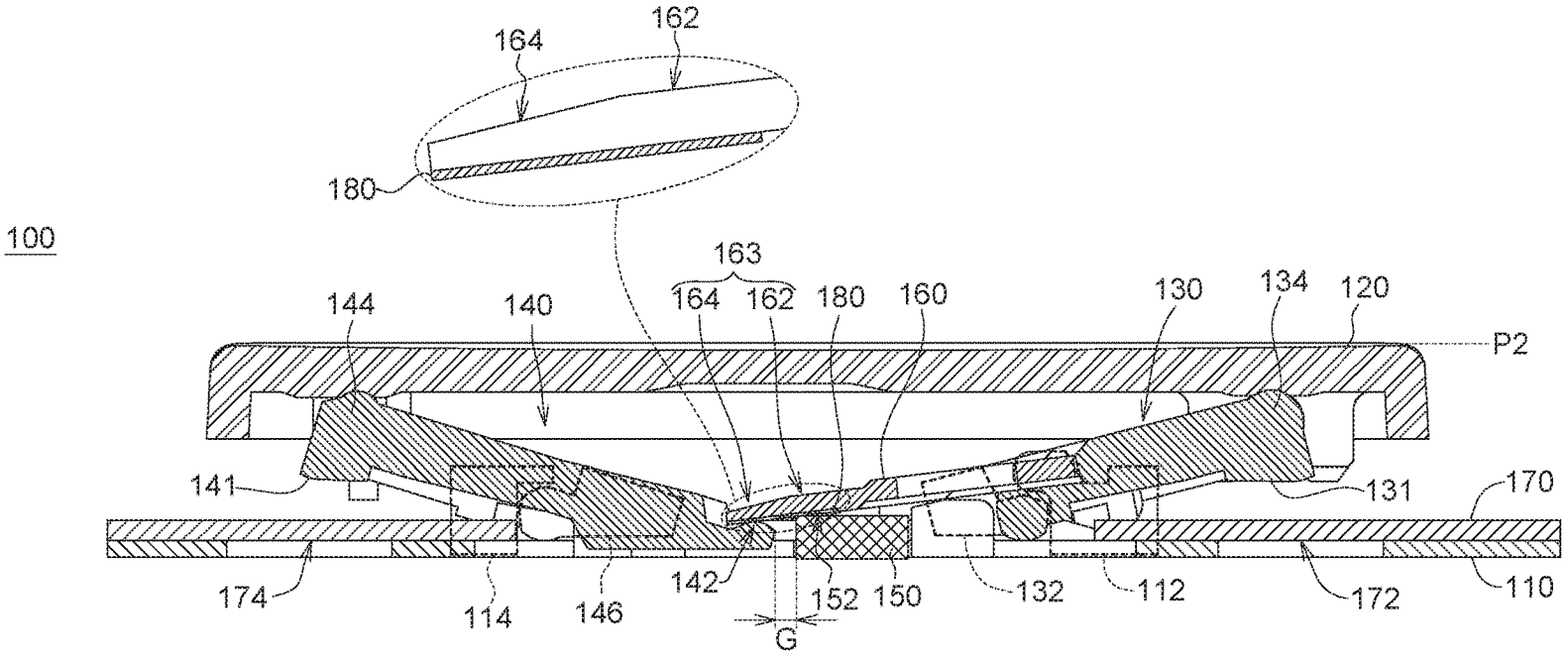
FIG. 2A is a cross-sectional view along a cross-sectional line A-A of the key structure of FIG. 1A not receiving an external force.
Figure 2B:
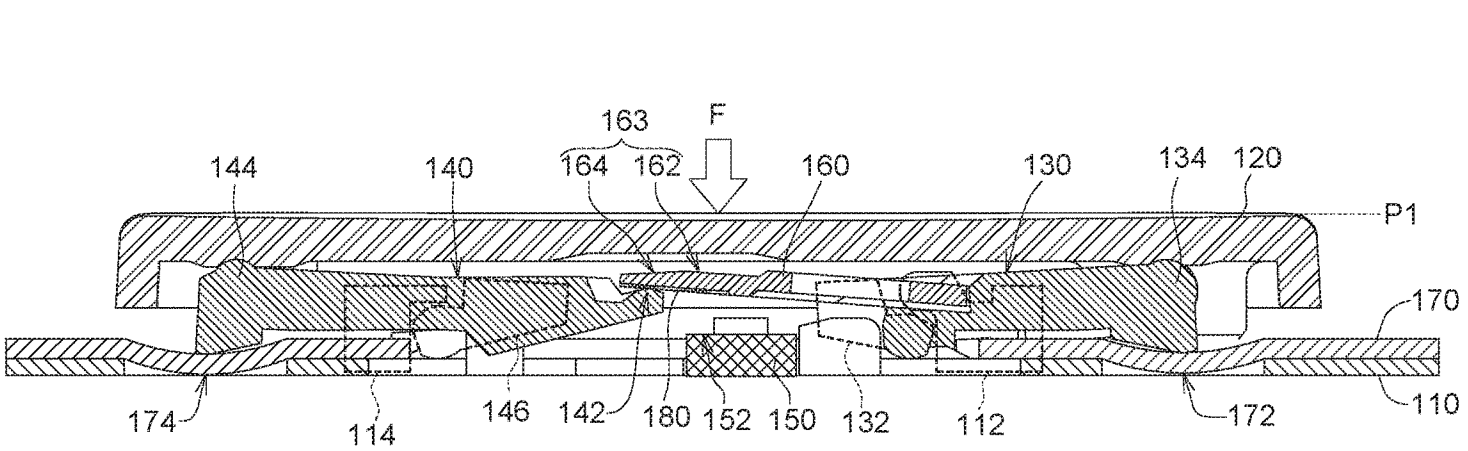
FIG. 2B is a cross-sectional view along a cross-sectional line A-A of the key structure of FIG. 1A receiving an external force.

FIG. 1A is an assembly diagram of a key structure 100 according to an embodiment of the present invention. FIG. 1B is an explosion diagram of a key structure 100 according to an embodiment of the present invention. FIG. 2A is a cross-sectional view along a cross-sectional line A-A of the key structure 100 of FIG. 1A not receiving an external force. FIG. 2B is a cross-sectional view along a cross-sectional line A-A of the key structure 100 of FIG. 1A receiving an external force.

Refer to FIGS. 1A and 1B. The key structure 100 according to an embodiment of the present invention includes a baseplate 110, a key cap 120, a first lever 130, a second lever 140, a first magnetic member 150, a second magnetic member 160, a circuit board 170 and a buffer material 180. The baseplate 110 has a first connecting portion 112 and a second connecting portion 114. The key cap 120 is disposed on the baseplate 110. The first lever 130 is pivotably disposed between the baseplate 110 and the key cap 120. The second lever 140 is pivotably disposed between the baseplate 110 and the key cap 120. The key cap 120 moves upwards and downwards with respect to the baseplate 110 through the first lever 130 and the second lever 14, wherein the first lever 130 and the second lever 140 are arranged in pairs on the left-hand side and the right-hand side of the key cap 120 to support the key cap 120, such that the key cap 120 can stably move upwards and downwards. As indicated in FIGS. 2A and 2B, the first magnetic member 150 is disposed on the baseplate 110 and located between the first lever 130 and the second lever 140. The second magnetic member 160 is disposed on the first lever 130 and corresponding to the first magnetic member 150. A magnetic force generated between the first magnetic member 150 and the second magnetic member 160 enables the key cap 120 to move upwards to a higher position P2 of FIG. 2A from a lower position P1 of FIG. 2B.

Refer to FIGS. 1A and 1B. In the present embodiment, the first lever 130 has a first central end 132, a first outer edge 134 and a third connecting portion 136. The third connecting portion 136 is located between the first central end 132 and the first outer edge 134. The third connecting portion 136 is rotatably coupled to the first connecting portion 112 of the baseplate 110. The first outer edge 134 is rotatably coupled to the key cap 120. Besides, the second lever 140 has a second central end 142, a second outer edge 144 and a fourth connecting portion 146. The fourth connecting portion 146 is located between the second central end 142 and the second outer edge 144. The fourth connecting portion 146 is rotatably coupled to the second connecting portion 114 of the baseplate 110. The second outer edge 144 is rotatably coupled to the key cap 120.

The first central end 132 and the second central end 142 respectively are the portion of the first lever 130 and the portion of the second lever 140 that are close to the center of the key cap 120. The first outer edge 134 and the second outer edge 144 respectively are the portion of the first lever 130 and the portion of the second lever 140 that are close to two opposite sides of the key cap 120. The distance between the first central end 132 and the second central end 142 is smaller than the distance between the first outer edge 134 and the second outer edge 144. Refer to FIGS. 2A and 2B. When a press key receives an external force F which enables the key cap 120 to move towards the lower position P1, the first central end 132 and the second central end 142 both move upwards and the first outer edge 134 and the second outer edge 144 both moves downwards, such that the first lever 130 and the second lever 140 rotate around the third connecting portion 136 and the fourth connecting portion 146, respectively. In the present embodiment, the third connecting portion 136 of the first lever 130 and the first connecting portion 112 of the baseplate 110 can be coupled together in the form of a flange and a baffle; the fourth connecting portion 146 of the second lever 140 and the second connecting portion 114 of the baseplate 110 can be coupled together in the form of a flange and a baffle or by other means such as a pivoting structure, and the present invention is not limited thereto.

Moreover, the first magnetic member 150 has a first portion 152. The second magnetic member 160 has a second portion 162 and a third portion 164. The second portion 162 extends above the first magnetic member 150 and is corresponding to the first portion 152 of the first magnetic member 150. The third portion 164 extends above the second central end 142 of the second lever 140 and is corresponding to the second central end 142. In the present embodiment, to avoid the first magnetic member 150 and the second magnetic member 160 colliding each other and generating noises, a buffer material 180 is provided between the first portion 152 and the second portion 162 to reduce the collision sound generated between the second portion 162 and the first portion 152 of the first magnetic member 150. Furthermore, to avoid the second magnetic member 160 and the second lever 140 colliding each other and generating noises, the buffer material 180 extends towards the second lever 140 and extends to the space between the third portion 164 and the second central end 142. Thus, the collision sound generated between the second magnetic member 160 and the second central end 142 can be reduced.

Refer to FIGS. 1A, 1B, 2A and 2B. To put it in greater details, the first central end 132 of the first lever 130 has a recess 133; the second magnetic member 160 has a body portion 161 and a protruding portion 163; the body portion 161 is embedded in the recess 133; the protruding portion 163 extends above the second central end 142 of the second lever 140 from the body portion 161. The protruding portion 163 can further be divided into a second portion 162 and a third portion 164. The second portion 162 is located above the first magnetic member 150. The third portion 164 is located above the second central end 142 of the second lever 140.

When the key structure 100 receives an external force F which enables the key cap 120 to move towards a lower position P1 from a higher position P2, the first central end 132 of the first lever 130, the second magnetic member 160 and the second central end 142 of the second lever 140 all move upwards, and the first portion 152 of the first magnetic member 150 and the second portion 162 of the second magnetic member 160 move away from each other.

When the external force F disappears (for example, when the external force is released), a magnetic force generated between the first magnetic member 150 and the second magnetic member 160 enables the second magnetic member 160 to move downwards, the second central end 142 of the second lever 140 is driven by the third portion 164 of the second magnetic member 160 to move downwards, and the key cap 120 moves towards the higher position P2 from the lower position P1.

It should be noted that when the key cap 120 moves towards the lower position P1 from the higher position P2, a gap may be generated between the third portion 164 and the second central end 142 due to the difference in velocities of movements despite that the third portion 164 and the second central end 142 concurrently move upwards. When the key cap 120 just arrives at the lower position P1, the third portion 164 has already stopped movement, but the second central end 142 continues to move upwards for a distance of the gap. Thus, the second central end 142 will collide with the bottom surface of the third portion 164 and generate a sound. In the present invention, a buffer material is provided between the third portion 164 and the second central end 142 to generate a buffer and damping effect to reduce the collision sound generated between the second magnetic member 160 and the second central end 142.

Also, when the key cap 120 moves towards the higher position P2 from the lower position P1, the second portion 162 of the second magnetic member 160 is driven by a magnetic attraction force to move downwards to collide with the first magnetic member 150 and generate a sound. Thus, in the present invention, a buffer material is provided between the second portion 162 and the first portion 152 to generate a buffer and damping effect to reduce the collision sound between the second magnetic member 160 and the first magnetic member 150.

In an embodiment, the buffer material 180 can be realized by a viscous colloid, such as a sticky grease or a lubricant, having the features of viscosity, wear resistance, high lubrication and good noise reduction. Therefore, the viscous colloid enables the third portion 164 of the second magnetic member 160 and the second central end 142 of the second lever 140 to be adhered and attracted together. Since no gap is generated, the third portion 164 of the second magnetic member 160 and the second central end 142 of the second lever 140 will not collide will each other and generate noises. In an embodiment, the viscous colloid may be a non-silicone grease, and has a hardness between 285 U.W~305 U.W at a temperature of 25° C. The dropping point of the viscous colloid is about 205° C. The 24-hours evaporation of the viscous colloid at a temperature of 100° C. is about 0.1%. The 24-hours oil separation of the viscous colloid at a temperature of 100° C. is about 1.5%. The operating temperature of the viscous colloid is between −30° C.~150° C. Depending on actual needs, the viscous colloid complying with all or some of the above features can be selected, and the present invention is not limited thereto.

Refer to FIGS. 2A and 2B. The first portion 152 of the first magnetic member 150 is adjacent to the second central end 142 of the second lever 140, and a gap G of 1 mm is formed between the first portion 152 and the second central end 142. In the present invention, when a buffer material 180 is coated between the first portion 152 and the second portion 162 and between the second central end 142 and the third portion 164, respectively, the buffer material 180 also covers the gap G between the first portion 152 and the second central end 142. Thus, the buffer material 180 can be coated on the first portion 152 of the first magnetic member 150 and the second central end 142 of the second lever 140 by one coating process only.

Refer to FIGS. 2A and 2B. The circuit board 170 is disposed on the baseplate 110 and includes a first thin-film switch 172 and a second thin-film switch 174. The thin-film switch of the circuit board 170 can be formed of three thin-film layers, namely, a top circuit layer, a bottom circuit layer, and an insulating layer interposed between the top circuit layer and the bottom circuit layer. The top circuit layer and the bottom circuit layer can be conducted when receiving an external force. The first lever 130 has a first actuating portion 131 corresponding to the first thin-film switch 172. The second lever 140 has a second actuating portion 141 corresponding to the second thin-film switch 174. When the key cap 120 receives an external force, the first actuating portion 131 rotates with respect to the baseplate 110 to get closer to the circuit board 170 and press the first thin-film switch 172, and the second actuating portion 141 rotates with respect to the baseplate 110 to get closer to the circuit board 170 and press the second thin-film switch 174. Thus, the top circuit layer and the bottom circuit layer are conducted and generate a pressing signal.

Figure 3A:
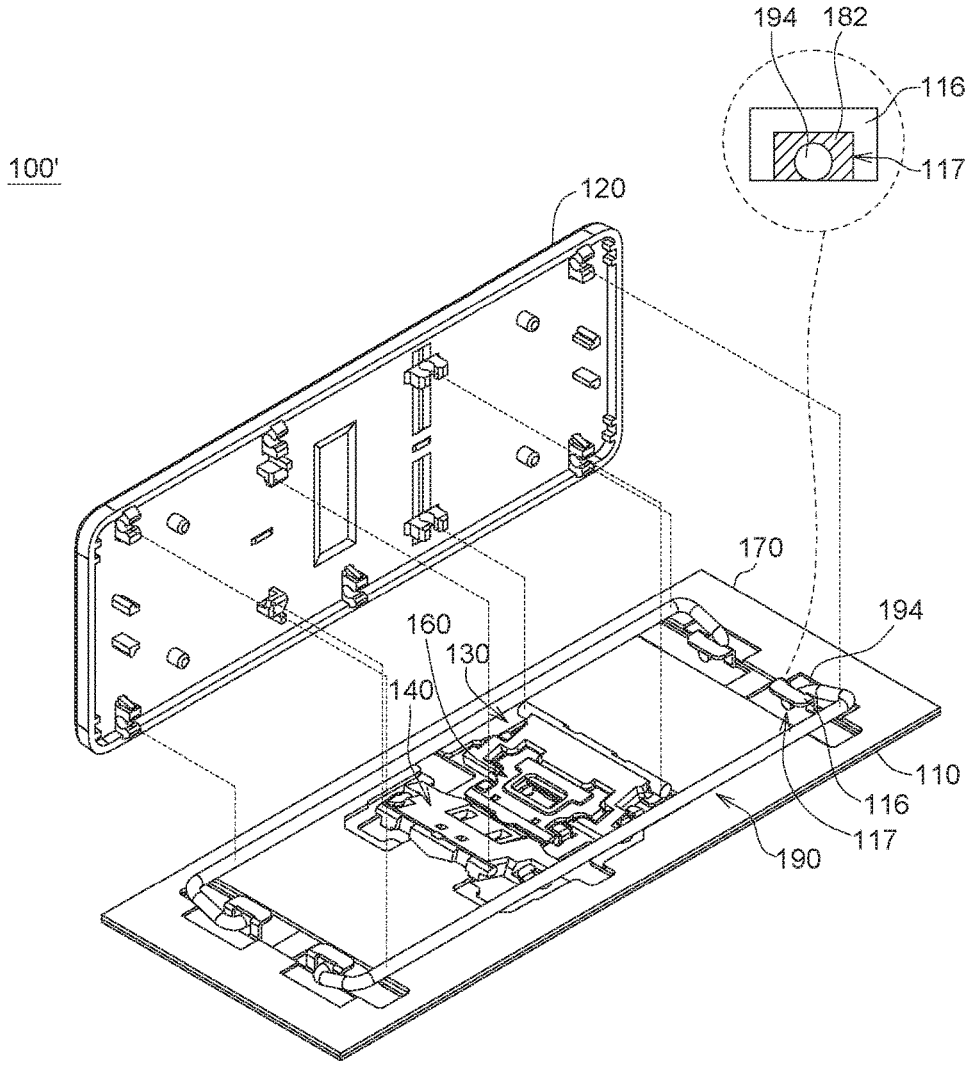
FIG. 3A is an assembly diagram and a partial enlargement of a key structure according to another embodiment of the present invention.
Figure 3B:
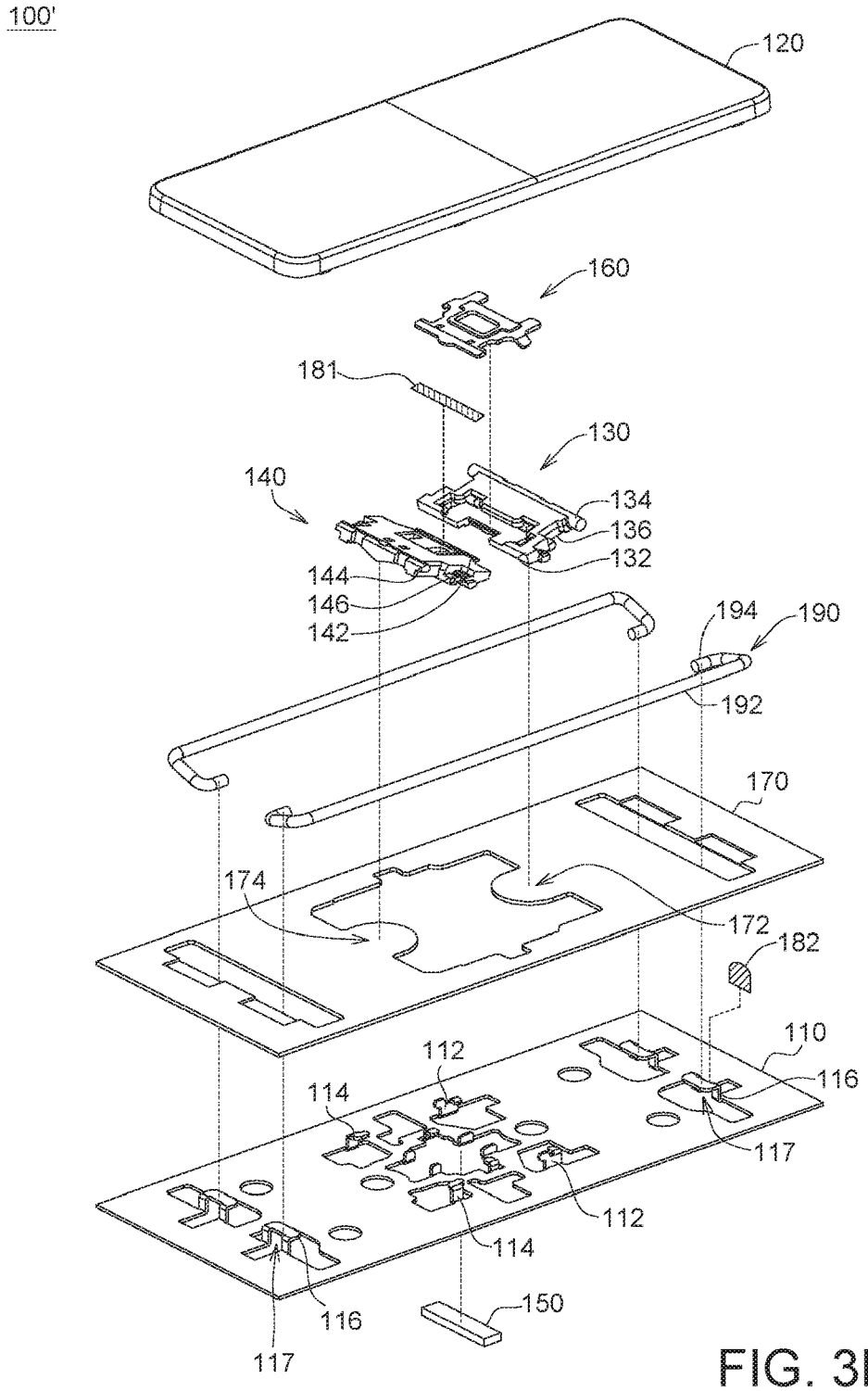
FIG. 3B is an explosion diagram of a key structure according to another embodiment of the present invention.

FIG. 3A is an assembly diagram and a partial enlargement of a key structure 100' according to another embodiment of the present invention. FIG. 3B is an explosion diagram of a key structure 100' according to another embodiment of the present invention. Refer to FIGS. 3A and 3B. The key structure 100' of the present embodiment is similar to the key structure 100 of above embodiments except that the key structure 100' further includes at least a balance rod 190 (two balance rods are illustrated in the diagram) disposed between the key cap 120 and the baseplate 110. The baseplate 110 includes at least a first positioning portion 116 (four first positioning portions are illustrated in the diagram). Each first positioning portion 116 is located under the side edge of the key cap 120 for positioning the balance rod 190. The balance rod 190 includes a top end portion 192 and a lower end portion 194. The top end portion 192 is rotatably coupled to the key cap 120. The lower end portion 194 is rotatably coupled to the baseplate 110. The first positioning portion 116 has a first receiving space 117. The lower end portion 194 is rotatably disposed in the first receiving space 117. In the present embodiment, the key structure 100' further includes a second buffer material 182 in addition to the first buffer material 181, which is similar to the buffer material 180 of the above embodiments. The second buffer material 182 is disposed in the first receiving space 117 for reducing the collision between the lower end portion 194 of the balance rod 190 and the first positioning portion 116.

In an embodiment, the first buffer material 181 and the second buffer material 182 can be formed of the same material, and can be concurrently coated under the second magnetic member 160 and in the first receiving space 117 respectively by the same manufacturing process. The second buffer material 182 may be a viscous colloid, such as a sticky grease or a lubricant, having the features of viscosity, wear resistance, high lubrication and good noise reduction. Besides, the first buffer material 181 and the second buffer material 182 are not limited to greases, any materials capable of being arranged to a designed position by a coating process and having buffer function can do, and the present invention is not limited thereto.

The key structure disclosed in above embodiments of the present invention has a buffer material disposed at the interference or the friction between two elements to avoid collision and friction. Thus, the noises generated when the elements actuate with respect to each other are reduced, and the press keys maintain quietness when being pressed.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key structure, comprising:

a baseplate;

a key cap disposed above the baseplate;

a first lever pivotably disposed between the baseplate and the key cap;

a second lever pivotably disposed between the baseplate and the key cap, wherein the key cap moves upwards and downwards with respect to the baseplate through the first lever and the second lever;

a first magnetic member disposed on the baseplate and located between the first lever and the second lever;

a second magnetic member disposed on the first lever and corresponding to the first magnetic member, wherein a magnetic force generated between the first magnetic member and the second magnetic member enables the key cap to move to a higher position from a lower position; the first magnetic member has a first portion; the second lever has a second central end; the first portion is adjacent to the second central end; the first magnetic member and the second magnetic member move towards each other when the key cap moves to the higher position; the second magnetic member has a second portion and a third portion; the second portion and the first portion lean against each other; the third portion and the second central end lean against each other; and a first buffer material provided between the first portion and the second portion and between the second central end and the third portion, respectively.

2. The key structure according to claim 1, wherein the first buffer material is a viscous colloid formed on the first portion and the second central end; when the key cap moves to the lower position, the first magnetic member and the second magnetic member move away from each other, such that the first portion and the second portion are separated from each other; the second magnetic member and the second lever are connected as one piece by the viscous colloid, such that the second central end and the third portion are not separated easily.

3. The key structure according to claim 2, wherein a gap is formed between the first portion and the second central end and is covered by the viscous colloid.

4. The key structure according to claim 2, wherein the viscous colloid is a non-silicone grease and has a hardness between 285 U.W-305 U.W at a temperature of 25° C.

5. The key structure according to claim 1, wherein the first central end of the first lever has a recess, the second magnetic member has a body portion and a protruding portion, the body portion is embedded in the recess, the protruding portion extends above the second central end of the second lever from the body portion, the second portion and the third portion are located at the protruding portion, and the second portion is located between the third portion and the recess.

6. The key structure according to claim 1, further comprising a circuit board disposed on the baseplate, wherein the circuit board comprises a first thin-film switch and a second thin-film switch, the first lever has a first actuating portion corresponding to the first thin-film switch, and the second lever has a second actuating portion corresponding to the second thin-film switch; when the first actuating portion rotates with respect the baseplate, the first actuating portion gets closer to the circuit board and presses the first thin-film switch; when the second actuating portion rotates with respect to the baseplate, the second actuating portion gets closer to the circuit board and presses the second thin-film switch.

7. The key structure according to claim 1, wherein the baseplate comprises a first positioning portion having a first receiving space, the key structure further comprises a balance rod having a lower end portion rotatably disposed in the first receiving space;

the key structure further comprises a second buffer material provided in the first receiving space to reduce a collision between the lower end portion and the first positioning portion, wherein the first buffer material and the second buffer material are formed of same material and are concurrently coated on the underneath of the second magnetic member and in the first receiving space by same manufacturing process.

8. The key structure according to claim 7, wherein the second buffer material is a viscous colloid, the viscous colloid is formed by a non-silicone grease and has a hardness between 285 U.W-305 U.W at a temperature of 25° C.

9. A key structure, comprising:

a baseplate having a first connecting portion and a second connecting portion;

a key cap disposed above the baseplate;

a first lever having a first central end, a first outer edge and a third connecting portion, wherein the third connecting portion is connected between the first central end and the first outer edge, the third connecting portion is rotatably coupled to the first connecting portion, and the first outer edge is rotatably coupled to the key cap;

a second lever having a second central end, a second outer edge and a fourth connecting portion, wherein the fourth connecting portion is located between the second central end and the second outer edge, the fourth connecting portion is rotatably coupled to the second connecting portion, and the second outer edge is rotatably coupled to the key cap, and the key cap moves upwards and downwards with respect to the baseplate between a lower position and a higher position through the first lever and the second lever;

a first magnetic member disposed on the baseplate, wherein the first magnetic member has a first portion;

a second magnetic member disposed at the first central end of the first lever, wherein a magnetic attraction force is generated between the first magnetic member and the second magnetic member, the second magnetic member has a second portion and a third portion, the second portion extends above the first magnetic member, and the third portion extends above the second central end of the second lever;

a first buffer material provided between the second portion and the first magnetic member and between the third portion and the second lever, respectively;

wherein when the key structure is pressed by an external force which enables the key cap to move towards the lower position, the first magnetic member and the second magnetic member move away from each other, and the second magnetic member and the second central end of the second lever both move upwards, the first buffer material reduces a collision sound generated between the second magnetic member and the second central end;

wherein when the external force disappears, the magnetic attraction force enables the key cap to move towards the higher position, the first magnetic member and the second magnetic member move towards each other, and the second portion of the second magnetic member moves downwards, the first buffer material reduces a collision sound generated between the second portion and the first portion of the first magnetic member.

10. The key structure according to claim 9, wherein the first buffer material is a viscous colloid formed on the first portion and the second central end; when the key cap moves to the lower position, the first magnetic member and the second magnetic member move away from each other, such that the first portion and the second portion are separated from each other; the second magnetic member and the second lever are connected as one piece by the viscous colloid, such that the second central end and the third portion are not separated easily.

11. The key structure according to claim 10, wherein a gap is formed between the first portion and the second central end and is covered by the viscous colloid.

12. The key structure according to claim 10, wherein the viscous colloid is a non-silicone grease and has a hardness between 285 U.W-305 U.W at a temperature of 25° C.

13. The key structure according to claim 9, wherein the first central end of the first lever has a recess, the second magnetic member has a body portion and a protruding portion, the body portion is embedded in the recess, the protruding portion extends above the second central end of the second lever from the body portion, the second portion and the third portion are located at the protruding portion, and the second portion is located between the third portion and the recess.

14. The key structure according to claim 9, further comprising a circuit board disposed on the baseplate, wherein the circuit board comprises a first thin-film switch and a second thin-film switch, the first lever has a first actuating portion corresponding to the first thin-film switch, and the second lever has a second actuating portion corresponding to the second thin-film switch; when the first actuating portion rotates with respect the baseplate, the first actuating portion gets closer to the circuit board and presses the first thin-film switch; when the second actuating portion rotates with respect to the baseplate, the second actuating portion gets closer to the circuit board and presses the second thin-film switch.

15. The key structure according to claim 9, wherein the baseplate comprises a first positioning portion having a first receiving space, the key structure further comprises a balance rod having a lower end portion rotatably disposed in the first receiving space;

the key structure further comprises a second buffer material provided in the first receiving space to reduce a collision between the lower end portion and the first positioning portion, wherein the first buffer material and the second buffer material are formed of same material and are concurrently coated on the underneath of the second magnetic member and in the first receiving space by same manufacturing process.

16. The key structure according to claim 15, wherein the second buffer material is a viscous colloid, the viscous colloid is formed by a non-silicone grease and has a hardness between 285 U.W-305 U.W at a temperature of 25° C.

* * * * *